US005226793A

United States Patent [19]

Stovall

[11] Patent Number: 5,226,793

[45] Date of Patent: Jul. 13, 1993

[54] BALLOON PUMP

[76] Inventor: Kalena D. Stovall, 636 Manning Ave., Hattiesburg, Miss. 39401, by Dinah Stovall, legal guardian

[21] Appl. No.: 704,408

[22] Filed: May 23, 1991

[51] Int. Cl.[5] ..... F04B 43/00

[52] U.S. Cl. ..... 417/437; 417/472

[58] Field of Search ..... 417/437, 472; 128/205.13, 205.14, 205.15, 205.16, 205.17

[56] References Cited

U.S. PATENT DOCUMENTS

| | | | |
|---|---|---|---|
| 238,136 | 2/1881 | Manwaring | 137/150 |
| 3,363,833 | 1/1968 | Laerdal | 417/472 |
| 4,112,963 | 9/1978 | Brubaker | 417/437 |
| 4,870,962 | 10/1989 | Sitnik | 128/205.13 |
| 5,067,487 | 11/1991 | Baumann | 128/205.13 |

*Primary Examiner*—Richard A. Bertsch
*Assistant Examiner*—Charles G. Freay
*Attorney, Agent, or Firm*—Dinah Stovall

[57] ABSTRACT

A manually compressible, self inflating, balloon shaped bulb that is used as a balloon air pump when connected to a hollow tubing that has an exit and an entrance port. A flap valve is located in each port to control air flow direction. Several graduating, circular rungs are located on the exit port for the easy attachment of items. Two adapters are used with the balloon pump to help make it able to inflate a large variety of inflatable objects. The adapters are a narrow ended cylinder adapter and a stretchable, flexible tubular adapter. An adapter base is used to support the adapters and to attach the adapters to the circular rungs on the exit port of the pump.

1 Claim, 2 Drawing Sheets

BALLOON PUMP

BACKGROUND OF THE INVENTION

The use of various types of compressable bulbs have been noted for at least a century. In 1881, Manwaring U.S. Pat. No. 2,238,136 described a siphon pump in which the pumping action of a collasible bulb starts an initial flow of liquid that is continued by the siphon action of the tube containing a valve chamber and inclined valves which forms the pump.

The Laerdal U.S. Pat. No. 3,363,833 describes an elastic bag for artificial respiration apparatus in which an elastic compressable bag with valves in both ends can be made small enough to be stored easily in a physician's bag by collapsing it within itself. But when in its distended state can be connected by a special valved end to a face mask for use as a resuscitator.

This present invention relates to the use of air pumps to inflate various inflatable objects. Even through a variety of pumps exist from compressors, to water pumps, to hand or foot operated air pumps, it was noted that many people continue to inflate balloons, inflatable toys and air mattresses, etc., by mouth. This pump device because of the convience of its shape as an inflater would help prevent shortness of breath, sore jaws, choking or suffocating if a deflated balloon where accidentally inhaled (especially by children) while attempting to inflate it by mouth. As these objects are deflated and then reinflated by mouth, the chances of contacting various infection causing germs and viruses are increased. An even more convient air pump deemed necessary that would be safe enough for children to use as a balloon pump, yet diversified enough to keep around as an in general inflater, that is even more so, when used with its adapters.

SUMMARY OF THE INVENTION

The main purpose of this invention is to provide a simple manual balloon pump device for inflation of balloons and other inflatable objects by providing a compressable, self inflating, balloon shaped bulb that is made of an elastic or rubber type, pliable yet sturdy material that could be repeatedly compressed and released and that would likely be manufactured in dimensions that would constitute sizes small, standard and large, for the purpose of being connected to a light weight, hollow tubing with air entrance and exit ports containing a valve in each port for the purpose of being used as a balloon pump device.

The one piece light weight air tube of plastic or similar molded material through which the flow if air is directed contains two openings. The opening closest to the pump serves as the air entrance port. The opening farthest from the pump serves as the air exit port. Each port contains a flap valve for air flow direction control. When the pump is compressed the force of air causes the air entrance flap valve to shoot upward and cap the opening causing air to exit through the exit port. When the pump is released the flap valve in the entrance port falls from the opening allowing the pump to reinflate. When the exit port is connected to an object to be inflated the force of the air that enters the object being inflated causes the flap valve to push up against the inner exit opening capping it, thus keeping the air inside the object being inflated. The flap valve would remain in place until pushed downwardly by another force of air exiting the port or until the exit port is disconnected from the object being inflated. The end of the tubing that contains the exit port has on its outer perimeter, circular rungs that descend from a wide to narrow diameter. The circular rungs are used to accomodate varying sized openings of objects to be inflated for the purpose of attachment.

A hollow, sturdy, cylindrical tube that is narrowed on one end tapering to a basic cone shape, of possibly plastic or similar material, is used as an adapter for openings too small for the exit port end of the balloon pump. A hollow somewhat stretchable, flexible tube of possible rubber or plastic material is used as an adapter that conventional inflating tips such as for playing balls and tires can be attached to by pushing them into the smaller end of the tube.

A means for the attaching and supporting of the adapters onto the circular rungs of the exit port section is provided through a flap adapter base that is possibly of plastic or similar material. As needed the cylindrical narrow ended adapter or the tube adapter can be inserted into the wider end of the base and extended through the narrow end of the base.

DETAILED DESCRIPTION OF THE DRAWINGS

Figure 1:
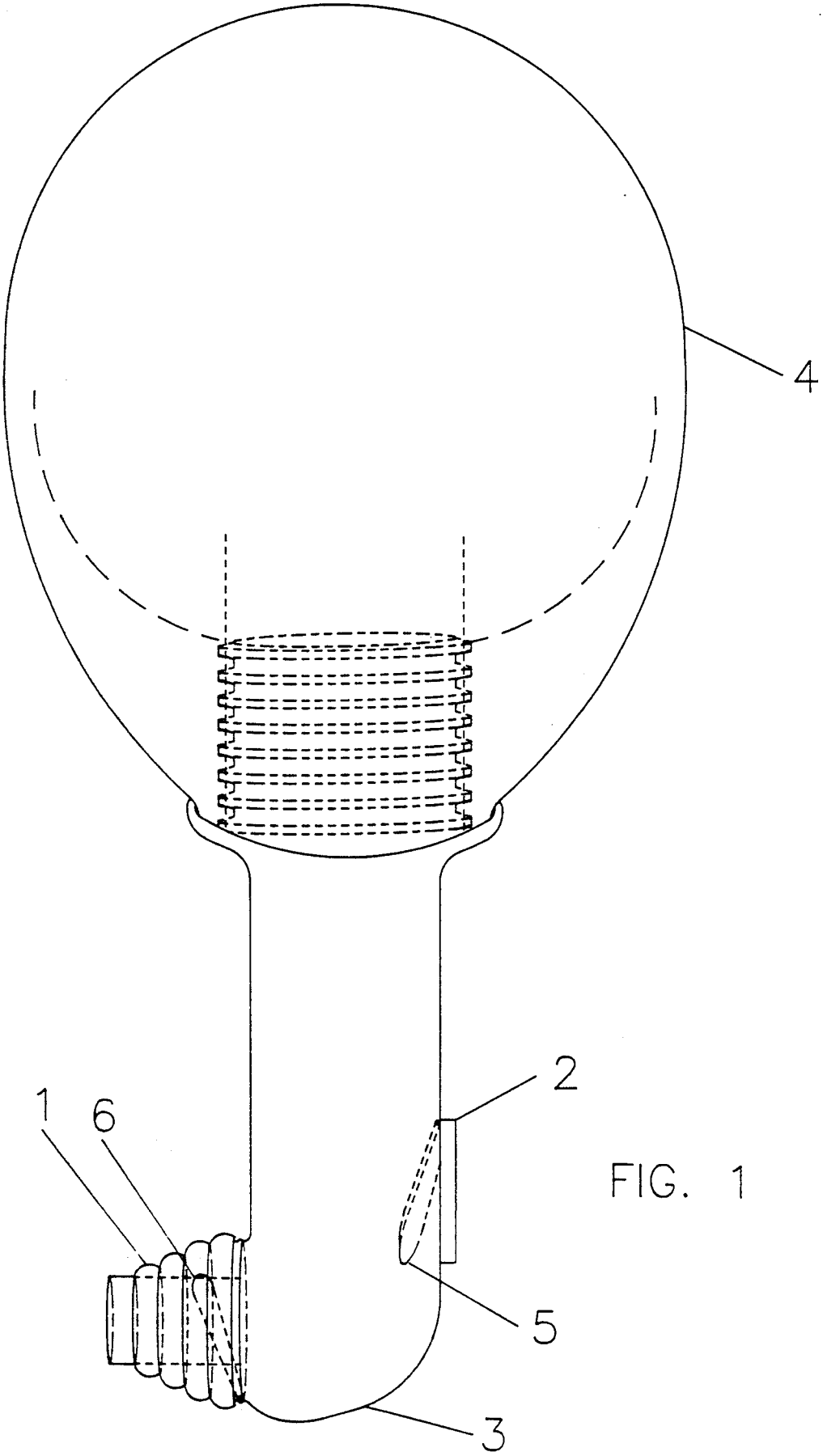
FIG. 1 shows an inner end and outer view of the compressable bulb and air tube comprising the balloon pump. It also shows the flap valves of the entrance and exit ports and the circular descending rungs on the convexed angled extension of the exit port.

In FIG. 1, the air balloon pump has a manually compressable rotunded or basic balloon shaped bulb 4 that provides the force of air for inflating. It is shown connected to the air tube 3 made of light weight material, which contains air inlet and outlet means as well as a means of connecting with items to be inflated. The air inlet port 2 of the air tube contains a flap valve 5 that snapps up ward covering the inlet port 2 inner opening when the bulb 4 is compressed causing the air to be forced out through the air exit port 1 opening. When the bulb 4 is released air reenters it through the air inlet port. The air exit port 1 contains a flap valve that opens to allow the force of air into the object connected onto the outer circular descending rungs of the port 1. The force of the air inside the object being inflated causes the flap valve 6 to be pushed upward covering the inner opening of the air exit port, thus keeping air inside the object being inflated until the object is removed. The outer descending rungs of the exit port 1 section of the air tube are used for attaching such items as balloons onto.

Figure 2:
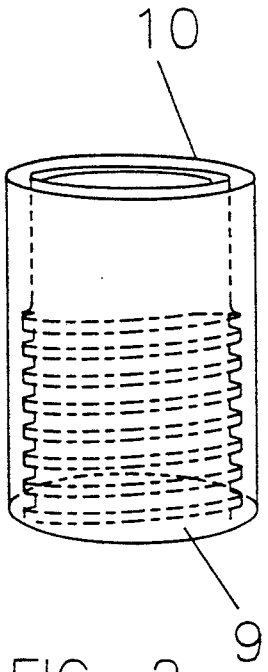
FIG. 2 shows the cylindrical adapter base.

FIG. 2 shows the cylindrical adapter base that serves as a means for supporting the narrow end cylinder adapter and the tubular adapter and for attaching them via the cylindrical adapter base by connecting its larger opening 9 onto the circular rungs of the exit port 1 of the air tube. Its smaller opened end 10 holds the adapter being used in place.

Figure 3:
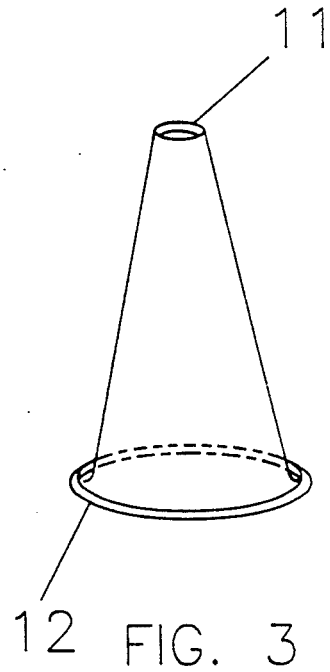
FIG. 3 shows the hollow, narrow ended cylinder adapter.

FIG. 3 shows the narrow ended cylinder adapter that is narrowed on one end 11 tapering to a basic cone shape. The wider end 12 of the cylinder is used to hold it steady in the cylindrical adapter base when it is inserted into the wider opening and extended through the smaller opening of the cylindrical adapter base.

Figure 4:
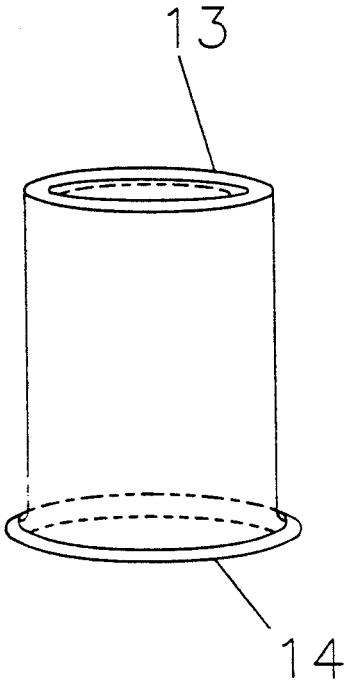
FIG. 4 shows the hollow, somewhat stretchable, flexible tubular adapter.

FIG. 4 is the tube shaped adapter that is of sturdy yet slightly flexible, stretchable rubber or plastic material that allows conventional inflating end pieces such as used for playing balls and tires to be pushed into the smaller end 13 of the adapter. After the tube adapter has been inserted into the larger opening and extended through the smaller opening of the adapter base the wider end 14 helps to hold the tube adapter steady in the adapter base.

Figure 5:
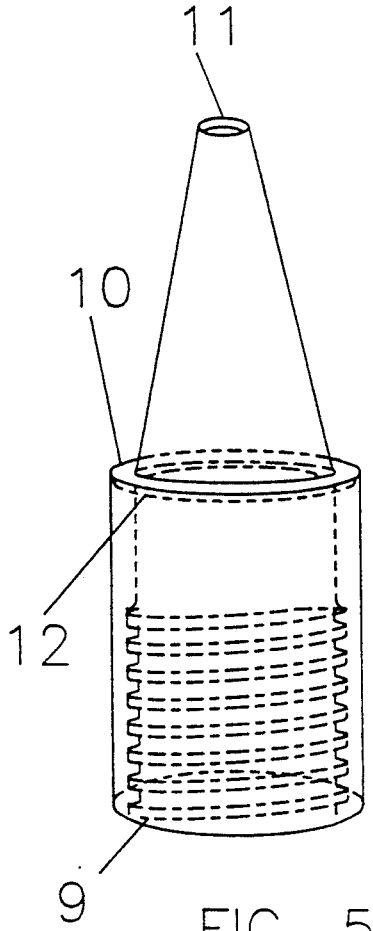
FIG. 5 shows the narrow ended cylinder adapter inserted into and extended through the cylindrical adapter base.

FIG. 5 shows the narrow ended cylinder adapter of FIG. 3 inserted into and though the cylindrical adapter base 10 of FIG. 2. The cylinder adapter and cylindrical adapter base combination would then be twisted or pushed into the circular rungs of the exit port 1 of FIG. 1.

The above rendering of description shall in no way limit the ways this invention may be practiced but shall be encompassing of many other variations that do not depart from the marked interest and intention of this invention.

I claim:

1. A manually operated bulb type pump comprising:

a pump tube having a bulb receiving means at a first end, an air outlet section at a second curved end, and a air entrance port between the first and second ends;

a manually compressible, self inflating bulb mounted on said bulb receiving means;

an inlet flapper valve located within said air entrance port;

an outlet flapper valve located within said air outlet section, said air outlet section including a plurality of outer circular rungs encircling the air outlet section and descending from a wide to a narrow diameter, the circular rung having the smallest diameter defining an air exit port, the descending circular rungs acting as a means for sealingly receiving an inflation adapter assembly or objects to be inflated; and an inflation adapter assembly mounted on said air outlet section comprising a cylindrical adapter base having open first and second ends, and an inflation adapter received within the adapter base and projecting from said cylindrical adapter base second end, said cylindrical adapter base first end being adapted for mounting on the circular rungs of the air outlet section.

* * * * *